US007698838B1

(12) United States Patent
Strayhorn

(10) Patent No.: US 7,698,838 B1
(45) Date of Patent: Apr. 20, 2010

(54) HOE EQUIPPED EXCAVATOR HAVING INCREASED RANGE

(76) Inventor: David W. Strayhorn, 188 Wellington La., Wichita Falls, TX (US) 76305

( * ) Notice: Subject to any disclaimer, the term of this patent is extended or adjusted under 35 U.S.C. 154(b) by 599 days.

(21) Appl. No.: 11/270,844

(22) Filed: Nov. 9, 2005

(51) Int. Cl.
*E01H 3/48* (2006.01)
*B66C 23/00* (2006.01)

(52) U.S. Cl. ..... 37/395; 37/443; 414/694; 414/713

(58) Field of Classification Search ..... 37/443, 37/444, 395, 397, 379; 414/708, 706, 710, 414/712, 694, 685, 722, 711, 700
See application file for complete search history.

(56) References Cited

U.S. PATENT DOCUMENTS

| | | | | | |
|---|---|---|---|---|---|
| 2,885,103 | A | * | 5/1959 | Cunningham, Jr. | 414/704 |
| 3,259,259 | A | | 7/1966 | Metailler | 214/138 |
| 3,389,820 | A | | 6/1968 | Borer et al. | 214/776 |
| 3,666,124 | A | * | 5/1972 | Arnold | 414/694 |
| 3,811,582 | A | | 5/1974 | Shumaker et al. | 214/138 |
| 3,862,697 | A | * | 1/1975 | Gill et al. | 414/700 |
| 3,913,768 | A | | 10/1975 | Grooss et al. | 214/774 |
| 4,109,807 | A | | 8/1978 | Yoshida | 214/131 R |
| 4,293,269 | A | * | 10/1981 | Zook | 414/686 |
| 4,314,789 | A | | 2/1982 | Luigi | 414/694 |
| 4,316,697 | A | | 2/1982 | Yokoyama | 414/694 |
| 4,393,607 | A | * | 7/1983 | Hirosawa | 37/443 |
| 4,444,542 | A | * | 4/1984 | Shaw et al. | 414/694 |
| 4,686,782 | A | * | 8/1987 | Nagatomo | 37/443 |
| 5,004,397 | A | * | 4/1991 | Schwappach | 414/686 |
| 5,088,213 | A | * | 2/1992 | Raimondo et al. | 37/379 |
| 5,584,643 | A | * | 12/1996 | Nishimura et al. | 414/694 |
| 5,661,917 | A | * | 9/1997 | Marchetta et al. | 37/348 |
| 5,711,096 | A | | 1/1998 | Kobayashi et al. | 37/443 |
| 5,822,892 | A | * | 10/1998 | Ohbatake et al. | 37/397 |
| 5,879,126 | A | * | 3/1999 | Kim | 414/713 |
| 5,885,050 | A | * | 3/1999 | Kim | 414/713 |
| 6,793,452 | B2 | | 9/2004 | Cusack et al. | 414/694 |
| 7,549,242 | B2 | * | 6/2009 | Schmeling et al. | 37/443 |
| 2003/0035710 | A1 | | 2/2003 | Cusack et al. | 414/694 |

FOREIGN PATENT DOCUMENTS

| | | | |
|---|---|---|---|
| JP | 55165335 | A * | 12/1980 |
| JP | 56146526 | A * | 11/1981 |
| JP | 56150234 | A * | 11/1981 |
| JP | 56150235 | A * | 11/1981 |
| JP | 60173224 | A * | 9/1985 |
| JP | 03224916 | A * | 10/1991 |

* cited by examiner

*Primary Examiner*—Thomas A Beach
(74) *Attorney, Agent, or Firm*—Baker Botts L.L.P.

(57) ABSTRACT

In one embodiment of the invention, a hoe equipped excavator includes a base, a boom pivotally mounted at one end on the base, a stick pivotally coupled at one end to the other end of the boom, a tool pivotally coupled to the other end of the stick, a boom link plate pivotally coupled to the boom, a lift cylinder coupled between the base and the boom link plate and an adjustment cylinder coupled between the boom link plate and the boom. The lift cylinder is operable to pivot the boom through a first circumferential range, and the adjustment cylinder is operable to pivot the boom beyond the first circumferential range.

18 Claims, 2 Drawing Sheets

100
116
106
114
108
OPEN
112
CLOSED
121
123
110
200
104
170
157
104
109
155
200
151
102
112
114
160
110
162
166
153
164
119
159
116
106
127
161
170
118
125

205
3
201
3
200
203

HOE EQUIPPED EXCAVATOR HAVING INCREASED RANGE

TECHNICAL FIELD OF THE INVENTION

The invention relates generally to excavators and, more specifically, to a hoe equipped excavator having increased range.

BACKGROUND OF THE INVENTION

Hoe-equipped excavators are primarily used to excavate below the natural surface of the ground on which the excavator rests. A hoe-equipped excavator normally includes a boom pivoted at one end on a vehicle, a stick pivotally connected at one end to the outer or front end of the boom, and a bucket pivotally mounted on the outer end of the stick. A hydraulic cylinder or cylinders under operator control are provided for operation of each of the boom, the stick, and the bucket. For example, a lift cylinder is typically coupled between the superstructure and a mid-section of the boom for pivotal control of the boom during raising and lowering of the bucket.

SUMMARY OF THE INVENTION

In one embodiment of the invention, a hoe equipped excavator includes a base, a boom pivotally mounted at one end on the base, a stick pivotally coupled at one end to the other end of the boom, a tool pivotally coupled to the other end of the stick, a boom link plate pivotally coupled to the boom, a lift cylinder coupled between the base and the boom link plate and an adjustment cylinder coupled between the boom link plate and the boom. The lift cylinder is operable to pivot the boom through a first circumferential range, and the adjustment cylinder is operable to pivot the boom beyond the first circumferential range.

Embodiments of the invention provide a number of technical advantages. Embodiments of the invention may include all, some, or none of these advantages. In one embodiment, a hoe equipped excavator possesses increased range from an extreme depth position to an extreme height position by the use of a boom link plate. Such increased range facilitates versatility of such an excavator by reducing the amount of movement of the superstructure, which saves time and money.

Other technical advantages are readily apparent to one skilled in the art from the following figures, descriptions, and claims.

BRIEF DESCRIPTION OF THE DRAWINGS

For a more complete understanding of the invention, and for further features and advantages, reference is now made to the following description, taken in conjunction with the accompanying drawings, in which.

DETAILED DESCRIPTION

Figures 1, 2:
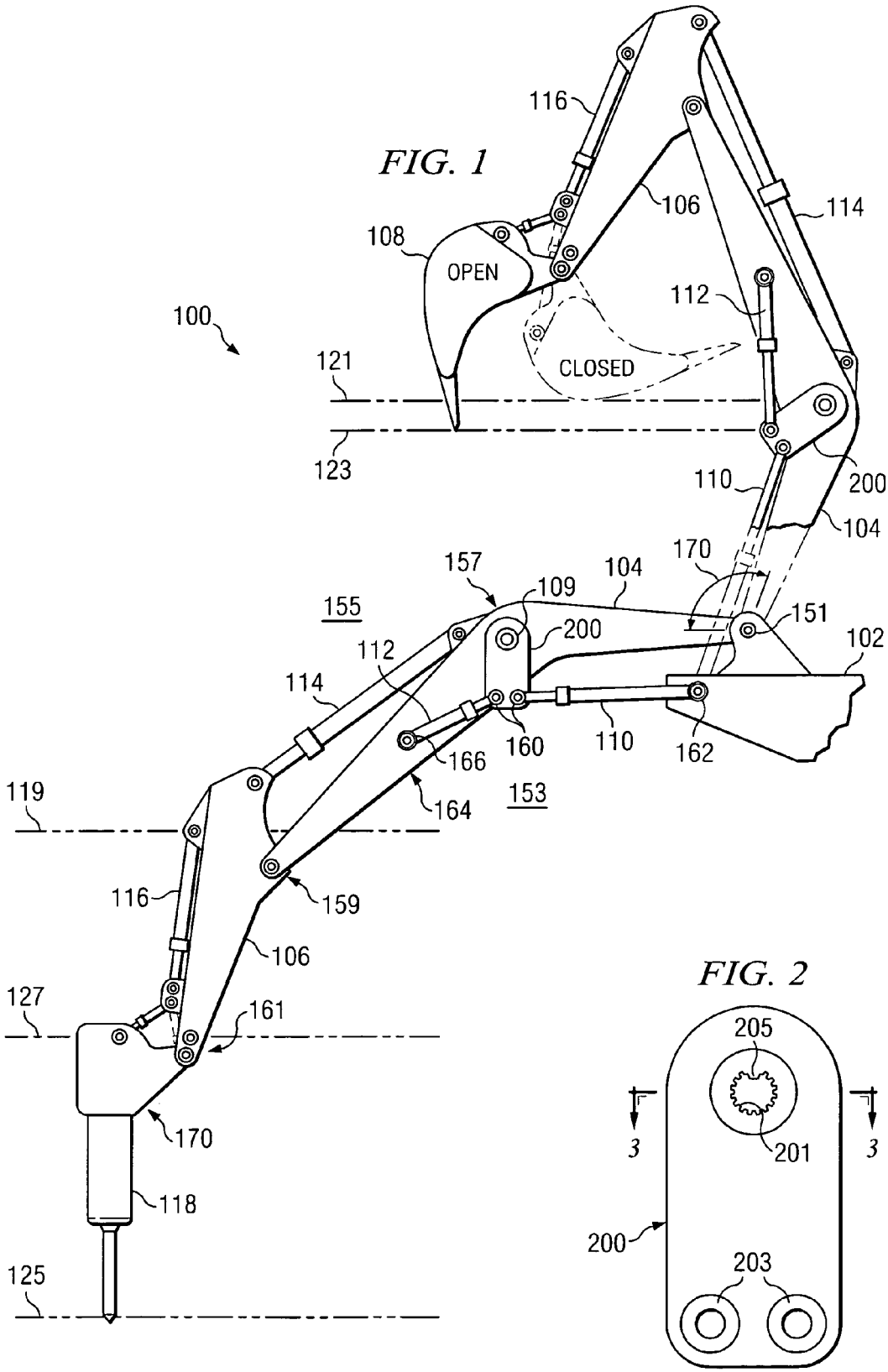
FIG. 1 is a schematic of a hoe equipped excavator illustrating the extreme height and depth of the tool by utilizing a boom link plate according to one embodiment of the invention.
FIG. 2 is an elevation view of the boom link plate according to one embodiment of the invention.

FIG. 1 is schematic of a hoe equipped excavator 100 according to one embodiment of the invention. Although the following detailed description discusses the invention for use with hoe equipped excavators, such as hoe equipped excavator 100, the present invention contemplates the invention being utilized for other suitable earth-moving equipment. In the illustrated embodiment, excavator 100 includes a base 102, a boom 104 pivotally mounted at one end to base 102, a stick 106 pivotally coupled at one end to the other end of boom 104, a tool 108 pivotally coupled to the other end of stick 106, a boom link plate 200 coupled to boom 104, a lift cylinder 110, an adjustment cylinder 112, a stick cylinder 114, and a tool cylinder 116. The present invention contemplates more, fewer, or different components for excavator 100 than those illustrated in FIG. 1.

Also illustrated in FIG. 1 are various "extremes" for tool 108, such as an extreme height for tool 108 in a closed position (as indicated by reference numeral 121), an extreme height for tool 108 in an open position (as indicated by reference numeral 123), an extreme depth of tool 108 in an open position (as indicated by reference numeral 125), and an extreme depth for tool 108 in a closed position (as indicated by reference numeral 127). These "extreme" positions are in reference to a ground level, as indicated by reference numeral 119, or other suitable reference position. One important advantage of the present invention is that the extreme heights and depths associated with excavator 100 are increased as a result of an increased circumferential range of boom 104 by utilizing boom link plate 200, lift cylinder 110, and adjustment cylinder 112 in conjunction with one another as described in greater detail below. Although described as extreme positions, excavator 100 can achieve even more range of position based on the operation and placement of lift cylinder 110, adjustment cylinder 112, and boom link plate 200.

Base 102 is any suitable base configured to support the various components of excavator 100. Base 102 may be a fixed base, a mobile base, a rotatable base, or other suitable support structure.

Boom 104 is pivotally mounted on base 102 in any suitable manner at a pivot point 151. Boom 104 is pivoted around pivot point 151 by the actuation of lift cylinder 110 and/or adjustment cylinder 112 in conjunction with boom link plate 200. The interaction of lift cylinder 110, adjustment cylinder 112, and boom link plate 200 are described in further detail below. Boom 104 may be any suitable size and shape; however, in one embodiment, boom 104 has a generally curved shaped such that it has a concave or lower side 153 that faces ground level 119 and a convex or upper side 155 that faces away from ground level 119. In this embodiment, the curved nature of boom 104 contemplates boom 104 being radially curved or angularly curved in any suitable manner. For example, in one particular embodiment of the invention, boom 104 is shaped like a boomerang that includes an apex portion 157.

Stick 106 may be any suitable size and shape and is coupled to boom 104 at a distal end 159 of boom 104 in any suitable manner. Stick 106 is rotatable around distal end 159 of boom 104 by a stick cylinder 114, which may be any suitable actuation device, such as a fluid-actuated cylinder.

Tool 108 may be any suitable device that excavates, digs, moves, mines, or otherwise processes earth or other materials. For example, and as an alternative to tool 108 illustrated as a bucket, excavator 100 is shown with a jackhammer in the extreme depth position. Tool 108 may be any suitable size and shape and couples to an end 161 of stick 106 in any suitable manner. Any suitable actuation device is contemplated by the present invention to actuate tool 108, such as tool cylinder 116, which may be any suitable actuation device, such as a fluid-actuated device. As described above, tool 108 is operable to be actuated from an open position to a closed position, and vice versa.

Each of the cylinders illustrated in FIG. 1 may be any suitable actuation devices operable to actuate the various components of excavator 100. For example, in one embodiment, each of the cylinders are fluid-actuated cylinders that operate on hydraulic fluid. However, other suitable mechanical or electromechanical actuation devices are contemplated by the present invention. In addition, these actuation devices may be controlled by an operator of excavator 100 or remotely controlled in any suitable manner. In one particular embodiment of the invention, adjustment cylinder 112 is a fixed length strut that does not actuate.

Boom link plate 200 is pivotally coupled to boom 104 at pivot point 109 in any suitable manner. One particular embodiment of coupling boom link plate 200 to boom 104 is illustrated and described below in conjunction with FIG. 3. Although only one boom link plate 200, lift cylinder 110, and adjustment cylinder 112 are shown in FIG. 1, another set of these components exists on the other side of boom 104 in one embodiment of the invention.

Referring now to FIG. 2, boom link plate 200 is illustrated according to one embodiment of the invention. Boom link plate 200 may be formed from any suitable material and may be any suitable size and shape depending on the dimensions and load rating of excavator 100. In the illustrated embodiment, boom link plate 200 includes a first bushing 201 in which the inner circumference of bushing 201 includes a plurality of splines in order to couple to a shaft that couples boom link plate 200 to boom 104. Bushing 201 also includes a master spline 205 to ensure proper alignment. This is described in greater detail below in conjunction with FIG. 3. A pair of bushings 203 may also be utilized to couple the rod ends of lift cylinder 110 and adjustment cylinder 112 thereto. Any suitable bushings are contemplated by the present invention for bushings 201, 203 and they may couple to boom link plate 200 in any suitable manner, such as welding.

As illustrated best in FIG. 1, the connection points of lift cylinder 110 and adjustment cylinder 112 to boom link plate 200, as indicated by reference numeral 160, are on the concave or lower side 153 of boom 104. In addition, in one embodiment, the connection point of lift cylinder 110 to base 102, as indicated by pivot point 162, is spaced forwardly from pivot point 151 where boom 104 is pivotally mounted to base 102. Other suitable connection points for lift cylinder 110 are contemplated by the present invention.

The other end of adjustment cylinder 112 is coupled to a distal portion 164 of boom 104 at a pivot point 166. Distal portion 164 is defined as the portion of boom 104 that is on the opposite side of boom link plate 200 with respect to base 102. Both lift cylinders 110 and adjustment cylinders 112 may be any suitable length.

As indicated above, the interaction of lift cylinder 110, adjustment cylinder 112, and boom link plate 200 facilitate increased circumferential range for boom 104, as indicated by the schematic of FIG. 1. This allows tool 108 to achieve extreme heights 121, 123 and extreme depths 125, 127. For example, in operation of one embodiment of the invention, as illustrated in FIG. 1, as tool 108 is actuated from an extreme depth to an extreme height, boom 104 moves in a circumferential range, as indicated by reference numeral 170. In the lower part of the range, lift cylinder 110 and adjustment cylinder 112 are both in a fully retracted position. In order to pivot boom 104 around pivot point 151 to the extreme height position, lift cylinder 110 may first be fully actuated outward. This movement outward by lift cylinder 110, while adjustment cylinder 112 is kept stationery, rotates boom 104 clockwise around pivot point 151 to a radial position that is less than an extreme height position shown in FIG. 1. As a result of this movement of lift cylinder 110, boom link plate 200 rotates around pivot point 109 counter-clockwise to account for the clockwise rotation of boom 104. To achieve the extreme height position and the advantages of the present invention, adjustment cylinder 112 is then actuated outward from its retracted position, while lift cylinder 110 is kept in its fully extended position, to rotate boom 104 around pivot point 151 in a clockwise direction to achieve an extreme height of boom 104. This actuation of adjustment cylinder 112 causes boom link plate 200 to further pivot around pivot point 109 in a counter-clockwise direction. Once adjustment cylinder 112 is fully actuated outward, then both lift cylinder 110 and adjustment cylinder 112 are fully actuated, thus allowing boom 104 to achieve its extreme height position and rotate throughout its full circumferential range.

Thus, an advantage of one embodiment of the invention is that the interaction of lift cylinder 110, adjustment cylinder 112, and boom link plate 200 operate to pivot boom 104 around pivot point 151 through a greater circumferential range than that of prior excavators that include only a single lift cylinder that couples between base 102 and pivot point 109 or some other location on boom 104.

Figure 3:
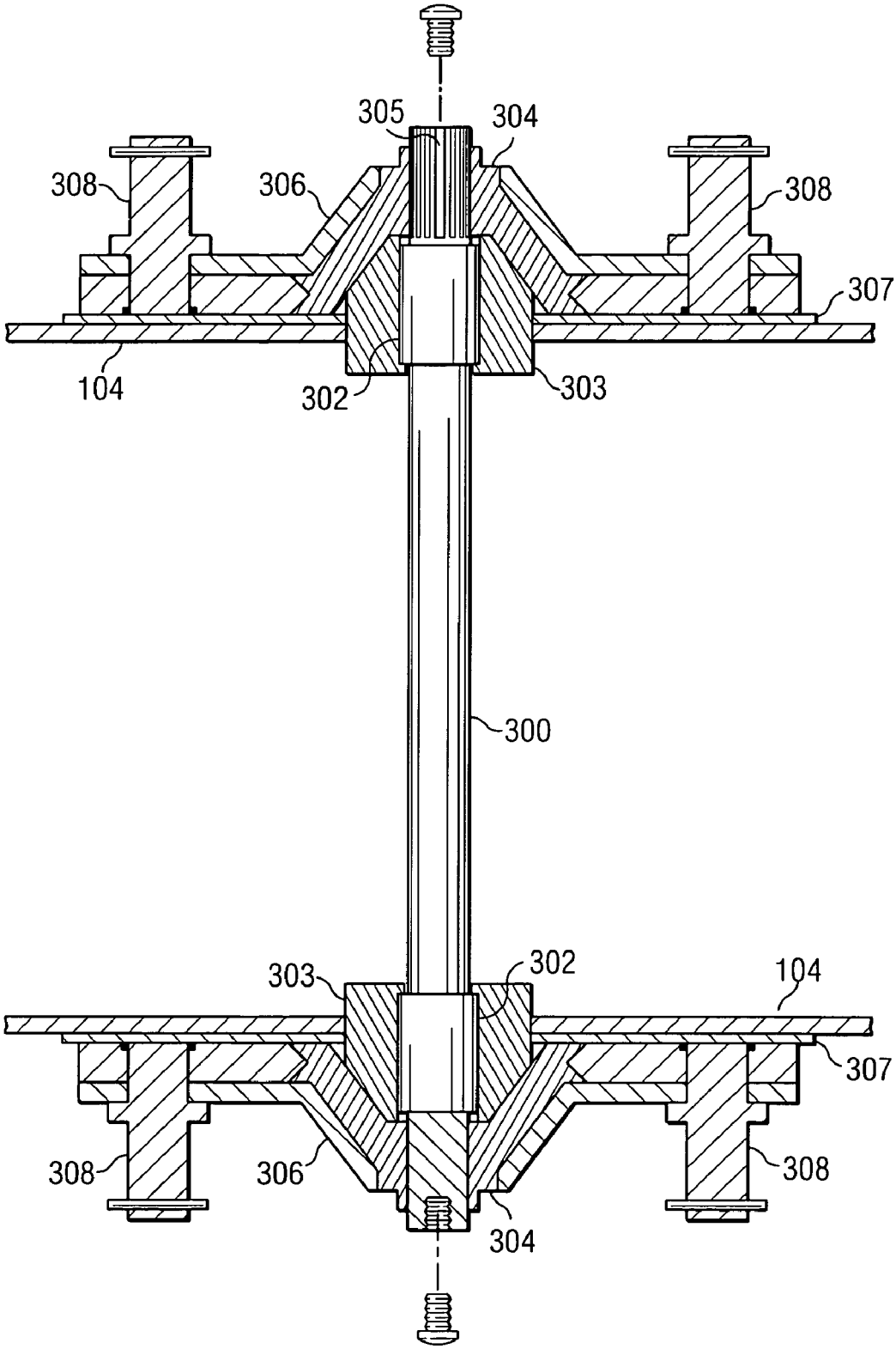
FIG. 3 is a cross-sectional view of the coupling of the boom link plate to the boom according to one embodiment of the invention.

Although boom link plate 200 may be coupled to boom 104 in any suitable manner in any suitable location, FIG. 3 illustrates a cross-sectional view of a coupling method of boom link 200 to boom 104 according to one embodiment of the invention.

Referring to FIG. 3, two boom link plates 200 are illustrated as being coupled to boom 104 by a shaft 300 having sleeve bushings 302. Sleeve 302 sets in a mounting hole 303 formed as a metal insert into each side of boom 104. In one embodiment, the ends of shaft 300 are splined to match up with the splines of spline hubs 304. Spline hubs 304 may have any suitable size and shape and may be coupled to boom link plate 200 in any suitable manner, such as welding. In the illustrated embodiment, spline hubs 304 have a frustoconical shape. Also, to maintain proper alignment between pairs of boom link plates 200, spline hubs 304 include a cooperating section 305 to receive master spline 205 of bushing 201.

An optional reinforcing plate 306 may couple to an outside surface of boom link plate 200 and/or spline hub 306. If utilized, reinforcing plate 306 may be any suitable size and shape and may couple to boom link plate 200 and/or spline hub 306 in any suitable manner, such as welding. The design of spline hubs 304 and the use of reinforcing plates 306 depend on the expected loads for excavator 100. A wear plate 307 disposed between boom 104 and spline hubs 304 allows movement of boom link plate 200 without significant wear and structural sacrifice to boom 104. A suitable lubricant may be placed between wear plate 307 and spline hubs 304. Also illustrated in FIG. 3 are suitable connector pins 308 that operate to connect lift cylinder 110 and adjustment cylinders 112 to boom link plate 200. Connector pins 308 may couple to boom link plate 200 in any suitable manner, such as welding.

Although embodiments of the invention and their advantages are described in detail, a person skilled in the art could make various alterations, additions, and omissions without departing from the spirit and scope of the present invention.

What is claimed is:

1. A hoe equipped excavator, comprising:

a base;

a boom pivotally mounted at one end on the base;

a stick pivotally coupled at one end to an other end of the boom;

a tool pivotally coupled to an other end of the stick;

a boom link plate pivotally coupled to the boom, wherein the boom is shaped like a boomerang consisting of an angular curve having first and second tapered ends and the boom link plate is coupled to the boom near an apex of the boomerang and the first tapered end is opposite of the base;

a lift cylinder coupled between the base and the boom link plate and operable to pivot the boom through a first circumferential range, wherein the lift cylinder couples to the boom link plate on a concave side of the boom; and an adjustment cylinder directly coupled between the boom link plate and the first tapered end of the boom opposite of the base and operable to extend outward from a retracted position to pivot the boom beyond the first circumferential range, wherein the adjustment cylinder couples to the boom link plate on the concave side of the boom.

2. The system of claim 1, further comprising a stick cylinder pivotally coupled at one end to an outer surface of the boom and operable to pivot the stick.

3. The system of claim 1, wherein a point of connection of the lift cylinder to the base is spaced forwardly from a point at which the boom is pivotally mounted on the base.

4. The system of claim 1, wherein the boom is shaped such that it has a convex side and a concave side.

5. The system of claim 4, wherein the connection points of the lift cylinder and adjustment cylinder to the boom link plate are on the concave side of the boom.

6. The system of claim 1, wherein the lift and adjustment cylinders comprise fluid-actuated, cylinders.

7. The system of claim 1, wherein the adjustment cylinder comprises a fixed length strut.

8. A method of actuating a boom, comprising:

pivotally mounting a boom at one end on a base;

pivotally coupling a stick at one end to an other end of the boom;

pivotally coupling a tool to an other end of the stick;

pivotally coupling a boom link plate to the boom, wherein the boom is shaped like a boomerang consisting of an angular curve having first and second tapered ends and the first tapered end is opposite of the base and wherein pivotally coupling comprises coupling the boom link plate near an apex of the boomerang;

coupling a lift cylinder between the base and the boom link plate, wherein coupling the lift cylinder comprises coupling the lift cylinder to the boom link plate on a concave side of the boom;

directly coupling an adjustment cylinder between the boom link plate and the first tapered end of the boom opposite of the base, wherein coupling the adjustment cylinder comprises coupling the adjustment cylinder to the boom link plate on the concave side of the boom;

pivoting the boom through a first circumferential range via actuation of the lift cylinder; and pivoting the boom beyond the first circumferential range via actuation of the adjustment cylinder, wherein actuating the adjustment cylinder comprises extending the adjustment cylinder outward from a retracted position.

9. The method of claim 8, further comprising pivotally coupling a stick cylinder at one end to an outer surface of the boom and pivoting the stick via actuation of a tool control cylinder.

10. The method of claim 8, further comprising coupling the lift cylinder to the base such that a point of connection of the lift cylinder is spaced forwardly from a point at which the boom is pivotally mounted on the base.

11. The method of claim 8, wherein the boom is shaped such that it has a convex side and a concave side.

12. The method of claim 11, further comprising causing the connection points of the lift cylinder and adjustment cylinder to the boom link plate to be on the concave side of the boom.

13. A system for actuating a boom of a hoe equipped excavator, comprising:

a boom pivotally coupled to a base;

a boom link plate pivotally coupled to the boom at a first pivot point, wherein the boom is shaped like a boomerang consisting of an angular curve having first and second tapered ends and the first pivot point is proximate an apex of the boomerang and the first tapered end is opposite of the base;

a lift cylinder coupled between the base and the boom link plate;

an adjustment cylinder directly coupled between the boom link plate and within the first tapered end of a distal portion of the boom opposite the base;

the coupling points of the lift cylinder and adjustment cylinder to the boom link plate exist on the lower side of the boom; and wherein the lift cylinder and the adjustment cylinder, in conjunction with the rotation of the boom link plate around the first pivot point, are operable to extend outward from a retracted position to pivot the boom through a greater circumferential range than if the lift cylinder was coupled between the base and the boom at the first pivot point.

14. The system of claim 13, further comprising a stick pivotally coupled at one end to the other end of the boom; and a stick cylinder pivotally coupled at one end to an outer surface of the boom and operable to pivot the stick.

15. The system of claim 13, wherein a point of connection of the lift cylinder to the base is spaced forwardly from a point at which the boom is pivotally mounted on the base.

16. The system of claim 13, wherein the lift and adjustment cylinders comprise fluid-actuated, cylinders.

17. The system of claim 13, wherein the adjustment cylinder comprises a fixed length strut.

18. A hoe equipped excavator, comprising:

a base;

a boom pivotally mounted at one end on the base, wherein the boom is shaped like a boomerang consisting of an angular curve having first and second tapered ends and the first tapered end is opposite of the base;

a stick pivotally coupled at one end to an other end of the boom;

a tool pivotally coupled to an other end of the stick;

first and second boom link plates each pivotally coupled to the boom near an apex of the boomerang, a boom link plate comprising three bushings, wherein a first bushing comprises a master spline operable to align the first boom link plate with the second boom link plate;

first and second lift cylinders each coupled between the base and the boom link plate and operable to pivot the boom through a first circumferential range, wherein a lift cylinder couples to a second bushing of the boom link plate on a concave side of the boom; and first and second adjustment cylinders each directly coupled between the boom link plate and the first tapered end of the boom opposite the base and operable to extend outward from a retracted position to pivot the boom beyond the first circumferential range, wherein an adjustment cylinder couples to a third bushing of the boom link plate on the concave side of the boom.

* * * * *